United States Patent [19]

Brushaber

[11] Patent Number: 4,462,329

[45] Date of Patent: Jul. 31, 1984

[54] MOORING LINE HOLDING DEVICE

[76] Inventor: Donald Brushaber, 221 Hayes Ct., Normandy Beach, N.J. 08739

[21] Appl. No.: 353,347

[22] Filed: Mar. 1, 1982

[51] Int. Cl.[3] ..... B63B 21/00

[52] U.S. Cl. ..... 114/230; 114/219

[58] Field of Search ..... 114/230, 219, 162, 221 R; 440/65; 403/113, 116, 117; 248/289.1, 290

[56] References Cited

U.S. PATENT DOCUMENTS

| | | | |
|---|---|---|---|
| 1,007,590 | 10/1911 | Miller | 248/289.1 |
| 1,722,402 | 7/1929 | Veilleux | 248/289.1 |
| 2,697,776 | 12/1954 | Wale | 248/291 |
| 3,151,595 | 10/1964 | Stainbrook | 114/230 |
| 3,280,784 | 10/1966 | Stainbrook | 114/230 |
| 3,576,988 | 5/1971 | Henning | 248/289.1 |
| 4,143,613 | 3/1979 | Paul | 114/221 R |
| 4,280,440 | 7/1981 | Barton | 114/230 |
| 4,335,862 | 6/1982 | Sherman | 248/289.1 |
| 4,337,764 | 7/1982 | Lerman | 403/116 |

*Primary Examiner*—Trygve M. Blix
*Assistant Examiner*—Stephen P. Avila
*Attorney, Agent, or Firm*—Samuelson & Jacob

[57] ABSTRACT

A device for holding a mooring line in position relative to a boat dock for facilitating the mooring of a boat at the dock includes a mounting member to be affixed to a pile or other vertical surface of the dock structure and a flexible rod carrying a mooring line holder and journalled in the mounting member for swinging movement in a horizontal plane between two fixed positions, one of which positions facilitates the pick-up of the mooring line from the holder when the boat approaches a moored location and the other of which positions facilitates the placement of the mooring line in the holder when the boat is in the moored location.

7 Claims, 3 Drawing Figures

MOORING LINE HOLDING DEVICE

The present invention relates generally to boating and pertains, more specifically, to a device which facilitates the mooring of a boat at a boat dock.

The increased popularity of boating in small boats has led to the necessity for accommodating larger numbers of boats within marinas where boats are continually being maneuvered into and out of docking facilities. For convenience, as well as for safety reasons, it is important to facilitate the handling of mooring lines during mooring operations.

It has been proposed that certain devices be used for retaining mooring lines in position for convenient grasping by a crew member on a boat which is being moored. One such device is described in U.S. Pat. No. 3,151,595 in which a horizontal member is affixed to a vertical member and carries a hook-shaped portion over which mooring lines can be draped so as to be retained at a fixed position relative to the boat to be moored with the mooring lines. Another mooring line retaining device is shown in U.S. Pat. No. 3,280,784. In the latter device, a mooring line retaining pole projects at an adjustable angle from a horizontal mounting plate for locating mooring lines at a convenient position for mooring operations.

It is an object of the present invention to provide a device for holding a mooring line in either of two selected positions so that the mooring line is located at a convenient position for pick-up as a boat approaches a moored location, and conveniently is placed in the device when the boat is in the moored location and is being prepared for departure.

Another object of the invention is to provide a device of the type described and in which a flexible rod extends horizontally and is journalled for swinging movement in a horizontal plane between a first position, where the device locates a mooring line for convenient pick-up by a crew member as a boat approaches a moored location, and a second position, where the device is located for convenient placement of a mooring line therein by a crew member in preparation for departure of the boat.

Still another object of the invention is to provide a device of the type described and in which the selected positions are selected easily in order to adapt the device readily to various installations.

Yet another object of the invention is to provide a device of the type described and in which the rod which holds the mooring line is manipulated easily and tends to remain in the position to which it has been moved.

A further object of the invention is to provide a device of the type described and in which the rod is flexible enough to preclude damage to a boat which might engage the rod and to avoid damage to the rod itself.

A still further object of the invention is to provide a device of the type described and which is relatively inexpensive to manufacture, easy to install and simple in use.

Yet a further object of the invention is to provide a device of the type described and which includes a simplified construction of materials well able to withstand corrosion and other deleterious effects experienced during service so as to enable an extended useful service life.

The above objects, as well as still further objects and advantages, are attained by the present invention which may be described briefly as a device for holding a mooring line in position relative to a boat dock for facilitating the mooring of a boat at the dock; the device comprising: a mounting member; mounting means on the mounting member for mounting the mounting member upon a vertical surface associated with the boat dock; a support upon the mounting member, the support being oriented so as to extend horizontally when the mounting member is mounted upon the vertical surface; an elongate flexible rod extending between opposite ends in a direction parallel to the extent of the support and mounted adjacent one end thereof upon the mounting member for swinging movement within a plane generally parallel to the extent of the support; mooring line holding means on the rod adjacent the other end of the rod for holding the mooring line on the rod; and stop means for defining the limits of the swinging movement of the rod such that the rod is movable along a path of movement between a first position wherein the rod projects outwardly toward the boat when the boat approaches an inward moored location at the dock for facilitating the pick-up of the mooring line held in the mooring line holding means, and a second position wherein the rod is swung inwardly toward the dock for facilitating the placement of the mooring line in the mooring line holding means when the boat is in the inward moored location, in preparation for departure.

The invention will be understood more fully, while still further objects and advantages will become apparent, in the following detailed description of a preferred embodiment of the invention illustrated in the accompanying drawing, in which.

Figure 1:
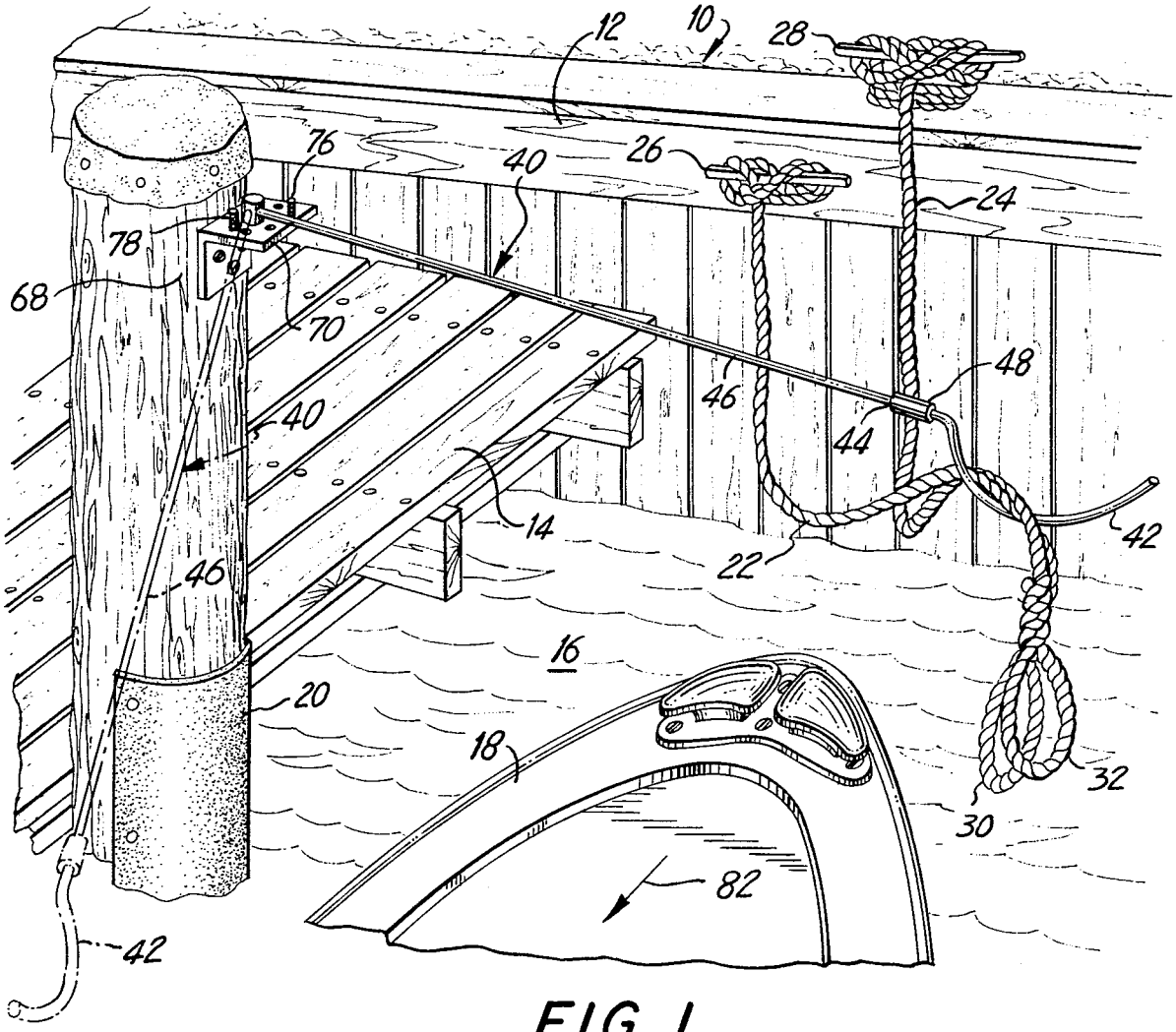
FIG. 1 is a pictorial illustration of a device constructed in accordance with the invention and installed at a boat dock.

Referring now to the drawing, and especially to FIG. 1 thereof, a boat dock is illustrated at 10 and is seen to include a vertical sea wall 12 from which there extends a horizontal pier 14 to establish a slip 16 within which a boat 18 is to be moored. A pile 20 serves as a vertical support for the pier 14, in a manner which is common in marinas. Mooring lines 22 and 24 are secured to corresponding cleats 26 and 28 affixed to the sea wall 12. Loops 30 and 32 at the corresponding ends of lines 22 and 24 will be placed around cleats (not shown) on the boat 18 to moor the boat 18 in the slip 16.

As depicted in FIG. 1, loops 30 and 32 of lines 22 and 24 have been released from boat 18 and the boat is ready for departure from the slip 16. Lines 22 and 24 have been draped over a mooring line holding device 40, constructed in accordance with the invention, by a crew member (not shown) who has released the lines 22 and 24 from the boat and has placed the lines 22 and 24 within a hook-like holder 42 of the device 40, while remaining on board, in preparation for departure.

Figure 2:
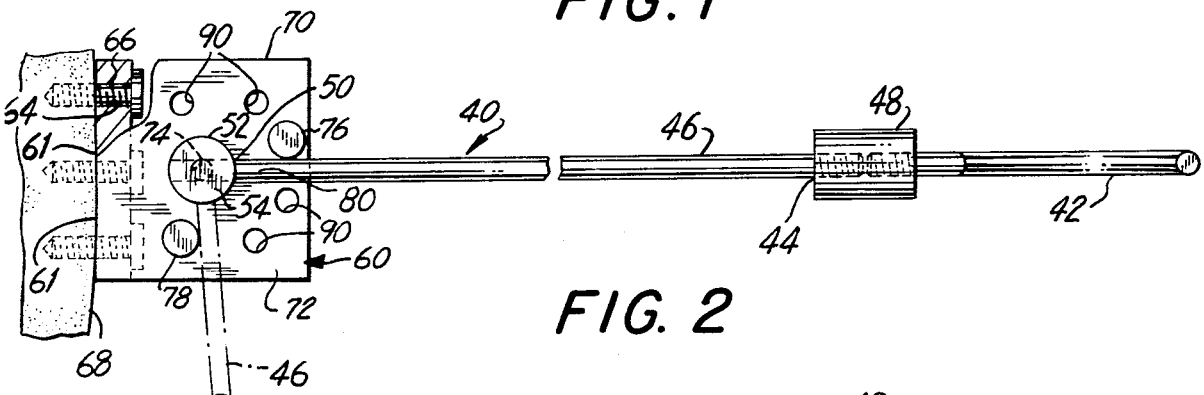
FIG. 2 is a top plan view of the device.
Figure 3:
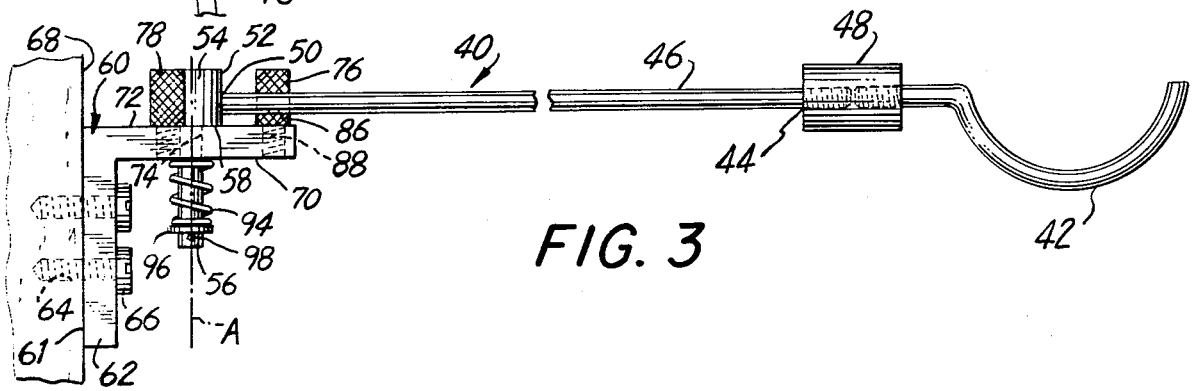
FIG. 3 is a front elevational view of the device.

Turning now to FIGS. 2 and 3, as well as to FIG. 1, holder 42 is fixed to one end 44 of an elongate rod 46 by a threaded coupling 48. At the other end 50, rod 46 is secured to a vertical shaft 52 having an upper enlarged cylindrical head 54 and in integral lower depending axle 56. A bearing surface 58 is located beneath head 54, for purposes which will be described below.

Device 40 includes a mounting member in the form of a bracket 60 having a mounting means which includes a vertical mounting surface 61 located on a web 62 having mounting holes 64 through which mounting screws 66 are passed to secure the web 62 upon the vertical surface 68 provided by pile 20. Of course, alternate vertical surfaces are available at boat docks for receiving vertical mounting surface 61 of web 62. Bracket 60 further includes a support 70 which projects generally perpendicular to mounting surface 61 of web 62 and includes a horizontal support surface 72.

Axle 56 of shaft 52 passes through a bore 74 in support 70 and bearing surface 58 rests upon support surface 72 so that shaft 52 is journalled for rotation in support 70 about a vertical axis A (see FIG. 3). Thus, swinging means is provided so that rod 46 is journalled for swinging movement in a plane parallel to the horizontal plane of support surface 72. Stop means in the form of stop pegs 76 and 78 delineate the angle through which rod 46 may swing by projecting vertically upwardly into the path of travel of portion 80 of rod 46 to stop the rod 46 at fixed positions determined by the placement of the stop pegs 76 and 78.

Returning to FIG. 1, rod 46 is shown swung inwardly so that the rod is positioned with portion 80 thereof against stop peg 76 and holder 42 generally juxtaposed with the bow of the boat 18 when the boat is in a moored location within slip 16. In that position, lines 22 and 24 may be released from the boat by a crew member aboard the boat and conveniently draped over holder 42, as shown. As the boat 18 is retracted from the slip 16, in the direction of arrow 82, or while the boat 18 still is stationary in the location shown, the same crew member may grasp the device 40, as at holder 42, so as to apply a swinging force to rod 46 to swing rod 46 to another position where portion 80 of the rod rests against stop peg 78, as shown in phantom (also see FIG. 2), so that rod 46 projects outwardly, toward the entrance to slip 16. In that position, the rod 46 will project outwardly toward the boat 18 as the boat approaches the slip 16 for mooring and the lines 22 and 24 will be located so as to facilitate pick-up of the lines by a crew member aboard the boat. Thus, the ability of the rod 46 to be swung by a crew member so as to be located at either of the two positions defined by stop pegs 76 and 78 enables device 40 to facilitate pick-up of the mooring lines as the boat approaches the slip 16, and dock 10, and placement of the mooring lines in the device 40 when the boat 18 departs from the slip 16.

Referring once again to FIGS. 2 and 3, stop pegs 76 and 78 each include a knurled head 86 and a threaded shank 88. A plurality of threaded apertures 90 are provided in support 70 so that stop pegs 76 and 78 may be located manually in selected apertures 90 to adapt device 40 to a wide variety of installations.

As set forth above, cylindrical head 54 of shafts 52 includes lower bearing surface 58 which rests upon support surface 72. Bearing surface 58 is biased against the support surface to establish a frictional force tending to maintain the rod 42 in any selected position along the path of travel thereof. Thus, biasing means is provided in the form of a helical spring 94 which extends along axle 56 between the support 70 and a retaining ring 96 retained upon axle 56 by a pin 98 passing through the axle 56. Spring 94 is in compression so that bearing surface 58 is urged against support surface 72 to establish the desired frictional force.

In order to preclude damage to the boat 18 as a result of any inadvertent engagement of the rod 46 by boat 18, rod 46 is made flexible. By construction rod 46 of a flexible material, such as glass fiber reinforced polyester, or another synthetic resin, the desired flexibility can be attained without losing the stiffness required to support the mooring lines. Holder 42 may be constructed of a harder material, such as stainless steel, in order to withstand wear which otherwise might result from contact with the mooring lines. Coupling 48 enables holder 42 to be replaced readily when necessary. The aforesaid materials will resist corrosion and are rugged enough to provide a long service life.

It will be seen that the device of the invention is relatively simple in construction and provides for the positioning of mooring lines in a convenient and inexpensive manner. The device is adapted readily to a variety of installations and adds to safety as well as convenience in boating.

It is to be understood that the above detailed description of an embodiment of the invention is provided by way of example only. Various details of design and construction may be modified without departing from the true spirit and scope of the invention as set forth in the appended claims.

The embodiments of the invention in which an exclusive property or privilege is claimed are defined as follows:

1. A device for holding a mooring line in either of a first position and a second position relative to a boat dock for facilitating the mooring of a boat at the dock, said device comprising:

a mounting member;

mounting means on the mounting member for mounting the mounting member upon a vertical surface associated with the boat dock;

a support upon the mounting member, said support being oriented so as to extend horizontally when the mounting member is mounted upon said vertical surface;

an elongate flexible rod extending between opposite ends in a direction parallel to the extent of the support;

swinging means mounting the elongate flexible rod adjacent one end thereof upon the mounting member for swinging movement within a plane generally parallel to the extent of the support between the first position and the second position in response to swinging forces applied to the elongate flexible rod;

mooring line holding means on the rod adjacent the other end of the rod for holding the mooring line on the rod;

stop means for defining the limits of the swinging movement of the rod such that the rod is movable along a path of movement in response to said swinging forces between the first position wherein the rod projects outwardly toward the boat when the boat approaches an inward moored location at the dock for facilitating the pick-up of the mooring line held in the mooring means, and the second position wherein the rod is swung inwardly toward the dock for facilitating the placement of the mooring line in the mooring line holding means when the boat is in the inward moored location, in preparation for departure; and means tending to maintain the rod in a selected position along the path of movement thereof in response to discontinuing the application of said swinging forces to the rod.

2. The invention of claim 1 wherein:

the mounting members includes a mounting surface for engaging the vertical surface associated with the boat dock;

the support includes a support surface extending generally perpendicular to the mounting surface;

the rod is journalled in the mounting member such that a portion of the rod is juxtaposed with the support surface during swinging movement of the rod between the first and second positions; and the stop means includes first and second stop pegs projecting from the support surface into the path of movement of the rod, at the portion of the rod juxtaposed with the support surface, to delineate the first and second positions.

3. The invention of claim 2 wherein the support includes means for selectively positioning the first and second stop pegs along the support surface for selectively locating the first and second positions.

4. The invention of claim 3 wherein the means for selectively positioning the stop pegs includes a plurality of apertures in the support and juxtaposed with the path of movement of the rod, each stop peg being selectively receivable in one of the apertures.

5. The invention of claim 4 wherein the means tending to maintain the rod in a selected position includes:

journalling means coupling the rod with the support, said journalling means including a bearing surface engaging the support surface; and biasing means biasing the bearing surface against the support surface to establish a frictional force tending to maintain the rod in the selected position along the path of movement thereof.

6. The invention of claim 1 wherein:

the mounting member includes a mounting surface for engaging the vertical surface associated with the boat dock;

the support includes a support surface extending generally perpendicular to the mounting surface; and the means tending to maintain the rod in a selected position includes:

journalling means coupling the rod with the support, said journalling means including a bearing surface engaging the support surface; and biasing means biasing the bearing surface against the support surface to establish a frictional force tending to maintain the rod in the selected position along the path of movement thereof.

7. The invention of claim 1, 4, 5 or 6 wherein the rod is constructed of a flexible material such as a glass fiber reinforced synthetic resin.

* * * * *